United States Patent [19]

Arai et al.

[11] 4,264,219

[45] Apr. 28, 1981

[54] DEVICE FOR DRIVING DOT PRINTING BARS IN A DOT PRINTER

[75] Inventors: Kiyoyuki Arai, Tokyo; Shigeo Kinoshita, Tokorozawa, both of Japan

[73] Assignee: Copal Company Limited, Tokyo, Japan

[21] Appl. No.: 42,973

[22] Filed: May 25, 1979

[30] Foreign Application Priority Data

May 31, 1978 [JP] Japan ..... 53-73701[U]

[51] Int. Cl.[3] ..... B41J 3/10

[52] U.S. Cl. ..... 400/121; 101/93.04; 400/124

[58] Field of Search ..... 400/121, 124, 125; 101/93.04, 93.05

[56] References Cited

U.S. PATENT DOCUMENTS

| | | | |
|---|---|---|---|
| 3,139,820 | 7/1964 | Kittler | 101/93.31 |
| 3,302,562 | 2/1967 | Nelson | 400/124 X |
| 3,715,020 | 2/1973 | Nordin | 400/124 |
| 4,077,336 | 3/1978 | Talvard et al. | 400/124 X |
| 4,077,505 | 3/1978 | Giolitti et al. | 400/124 |

OTHER PUBLICATIONS

IBM Tech. Disc. Bulletin, S. L. Applegate, vol. 21, No. 9, Feb. 1979, pp. 3964–3965.

*Primary Examiner*—Paul T. Sewell

*Attorney, Agent, or Firm*—Haseltine and Lake

[57] ABSTRACT

The device for driving dot printing bars in a dot printer comprises at least one dot printing bar movable between two positions, an electromagnetic device controlling the operation timing of the bar, a periodically reciprocal operation member operable when the electromagnetic device is made conductive and means operable to shift the dot printing position of the bar whereby the bar springs out to effect dot printing in response to the operation of the operation member when the electromagnetic device is energized to attract the operation member thereto.

2 Claims, 4 Drawing Figures

DEVICE FOR DRIVING DOT PRINTING BARS IN A DOT PRINTER

BACKGROUND OF THE INVENTION

This invention relates to a device for driving dot printing bars in a dot printer and more particularly, to a device for driving dot printing bars in a dot printer of the type in which the operation of an electromagnetic device is not directly utilized for driving a dot printing needle, but utilized as a printing control command for the dot printing operation. The dot printing bar drive device generally comprises dot printing bars, electromagnetic devices and operation members which normally operate periodically and in the drive device of the type, only when the electromagnetic device is supplied electric current thereto and provides attraction function, the bar springs out to the striking or dot printing position in a timed relationship to the periodically operable member.

There have been proposed and practically employed a variety of devices for driving dot printing bars in dot printers and in one of the prior art dot printing needle drive devices of the above type, the movable iron piece of an electromagnetic device is connected to a flexible or sheet metal dot printing bar at a point adjacent the rear end of the bar and the attraction function of the movable iron piece operates the bar directly so as to cause the bar to strike against a recording paper so as to effect dot printing on the recording paper.

However, the prior art dot printing bar drive device referred to hereinabove has the disadvantages that the attraction by the electromagnetic device itself serves as the force with which the dot printing bar strikes against the recording paper for effecting dot printing on the paper and/or that the electromagnetic device is inevitably required be constructed to have a large size because the movement stroke of the movable iron piece determines the spring-out or protruding distance of the dot printing bar resulting in a large size bar drive device.

SUMMARY OF THE INVENTION

Therefore, the present invention is to provide a novel and improved dot printing bar drive device which can effectively eliminate the disadvantages inherent in the prior art dot printing bar drive device.

The purpose of the present invention is to provide a novel and improved dot printing bar drive device in which an electromagnetic device exclusively serves to provide a printing control command and the striking force required by a dot printing bar for effecting dot printing can be provided from a separate drive source whereby the size of the electromagnetic device can be minimized and nevertheless, a great striking or dot printing force can be obtained.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
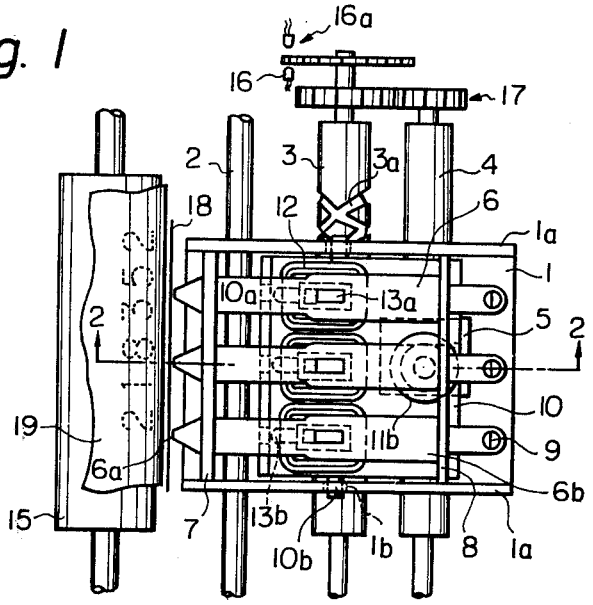
FIG. 1 is a top plan view of one preferred embodiment of bar drive device constructed in accordance with the present invention.
Figure 2:
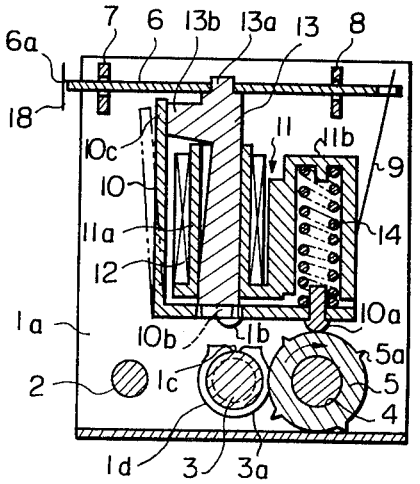
FIG. 2 is a cross-sectional view taken substantially along the line 2—2 of FIG. 1.

The present invention will be now described referring to the accompanying drawings and more particularly, to FIGS. 1 and 2 thereof in which one preferred embodiment of dot printing bar drive device of the invention is shown. In these Figures, reference numeral 1 denotes the outer framework of the bar drive device and the outer framework comprises a pair of parallel and spaced side plates 1*a* having aligned openings 1*d* with the projections 1*c* and aligned guide holes 1*b* positioned below the openings 1*d* for journalling the opposite ends of the rotary shaft 10*b* of a L-shaped rocking armature 10 of which description will be made hereinafter. Reference numeral 2 denotes a guide rod extending through the side plates 1 to guide the outer framework 1 in operation. Reference numeral 3 denotes a feed rod formed with a spiral groove 3*a* and extending through the aligned openings 1*d* in the side plates 1 and the projections 1*c* on the openings 1*d* fit in the spiral groove 3*a* to allow the outer framework 1 to move bodily and reciprocally. Reference numeral 4 denotes a rotary shaft extending through the side plates 1*a* for driving dot printing bars of which description will be made hereinafter. The rotary shaft 4 has a rotary cam 5 integrally formed therewith in a substantially center portion in the length of the shaft and is operatively connected through a gear train 17 to the feed rod 3 for rotation in synchronization with the rod. The rotary cam 5 is provided with spaced projections 5*a* in the outer periphery thereof. There is provided a sensor adapted to produce a desired printing signal just before or simultaneously when one of the projections 5*a* pushes up a pin 10*a* secured to the rocking armature 10 and having a semi-spherical head in the manner as will be described hereinafter. Reference numeral 6 denotes a bar formed of wear-resistant sheet metal and having a dot printing leading end face 6*a* at the leading end. The bars 6 is guided by guide plates 7, 8 secured to the side plates 1 and adapted to reciprocally move between an inoperative position and an operative or spriking position in the longitudinal direction (rightward and leftward directions as seen in FIG. 1). The bars are normally urged to the retracted or inoperative position (the right-hand position as seen in FIG. 1) by means of a leaf spring 9 secured to an electromagnetic device casing 11 of which description will be made hereinafter when the spring 9 engages in the hole formed at the rear end of the bar 6 and the rearward movement of the bar 6 is arrested by the abutment of the shoulder 6*b* of the needle 6 against the guide plate 8. The leading end face 6*a* of the bar 6 has a regular square cross-section for forming a dot.

The rocking armature 10 is formed of magnetic material and includes a pole contact portion 10*c* and a rotary shaft portion 10*b* so that the rocking armature 10 is rockably held between the side plates 1*a* with the shaft portion 10*b* freely received in the aligned holes 1*b* in the side plates 1*a*. The electromagnetic device casing 11 is formed of resin having high mechanical strength and heat-resistance and secured to the outer framework 1. The casing 11 includes a hollow winding core receiving portion 11*a* for an electromagnetic coil and a spring stowage portion 11*b*.

Reference numeral 12 denotes a coil wound about the hollow core receiving portion 11*a* and formed of a self-fusion wire. Reference numeral 13 denotes a movable pole piece formed of magnetic material and including a projection 13*a* and a pole portion 13*b*. The movable pole piece 13 is rockably received in the core receiving portion 11*a* and held in position therein by the rocking armature 10. The movable pole piece 13 is normally urged rightwards as seen in FIG. 1 under the biasing force of the spring 9 through the bar 6 with the projection 13*a* engaging in the hole at the rear end of the bar 6. The rocking armature 10 itself is biased rightwards as seen in FIGS. 1 and 2 under the force of compressed spring 14 received in the spring stowage portion 11*b*. Thus, the semi-spherical head of the pin 10*a* secured to the rocking armature 10 abuts against the outer periphery of the cam 5.

Reference numeral 15 denotes a platen which is operatively connected through the feed rod 3, a gear train (not shown) and an intermittently operable mechanism (not shown) to the feed rod 3 to be intermittently rotated thereby, reference numeral 16 denotes a detection plate secured to the feed rod 3 and rotates in synchronization with the dot position shift feeding of the bar 6 to produce a signal in cooperation with a photocoupler 16*a*, reference numeral 18 denotes an inked ribbon and reference numberal 19 denotes a recording paper adapted to be fed in increment together with the platen 15.

For convenience for explanation, although description has been made of each one of the various components of the bar drive device in the foregoing, it should be understood that the bar drive device is designed to dot print six units of figure and accordingly, three bars 6, three coils 12, three movable pole pieces 13 and three rocking armature pole portions 10*c*, respectively are provided as clear from FIGS. 1 and 2. The embodiment of bar drive device as described hereinabove is designed to dot print six units of figure, that is, the first bar is adapted to dot print ones of figure and tens of figure, the second bar is adapted to dot print hundreds of figure and thousands of figure and the third bar is adapted to dot print ten thousands of figure and hundred thousands of figure, respectively.

The operation of the embodiment of bar drive device of the invention as described hereinabove will be now made. It is assumed that the bar moves from the retracted or inoperative position towards the operative or striking position.

As the rotary cam 5 continues to rotate in the clockwise direction as seen FIG. 2, each time the projection 5*a* passes under the semi-spherical head of the pin 10*a* to push the pin upwardly, the rocking armature 10 rocks in one direction and then in the opposite direction. While the rocking armature 10 is rocking reciprocally, if no selection command is provided to the drive device, since the coil 12 is not supplied with electric current and the movable pole piece 13 has no attraction function, even if the rocking armature 10 rocks in the counterclockwise direction, the movable pole piece 13 will not follow the rocking movement of the rocking plate in the direction and thus, the bar 6 will not operate to dot print.

However, when a printing signal is produced and the coil 12 is supplied with electric current just before or simultaneously when one of the projection 5*a* on the cam 5 pushes the bar 10*a* upwardly, the movable pole piece 13 is energized to attract the rocking plate 10 thereto, and thus, when the rocking plate 10 is rocked in the counterclockwise direction by the particular projection 5*a* on the cam 5, the movable iron piece 13 rocks in the counterclockwise direction together with the rocking armature 10 rocking in the same direction whereby the bar 6 springs out or protrudes leftwards against the biasing force of the leaf spring 9. At this time, just before the movable pole piece 13 reaches the end of the counterclockwise rocking movement, the bar 6 strikes against a recording paper 19 to effect dot printing on the paper. On the other hand, the rocking armature 10 is allowed to rock further in the counterclockwise direction by a short angular distance and release from the attraction by the movable pole piece 13 whereupon the supply of electric current to the coil 12 is shut off and the bar 6 is moved back rightwards to the inoperative position under the biasing force of the spring 9. The rocking armature 10 is also rocked back in the clockwise direction to the initial position under the force of the compressed spring 14. The movable pole piece 13 also rocks back in the clockwise direction to the initial position together with the bar 6.

Figure 3:
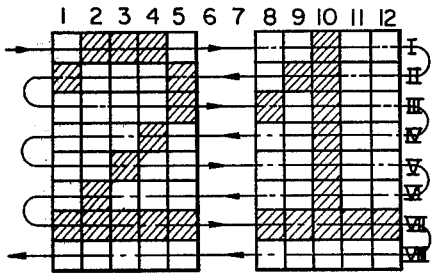
FIG. 3 is a view showing dot characters.

Next, the operation for printing dot characters in the first figure and the second figure such as "2" and "1", for example, by one of the bars will be described referring to FIGS. 1 and 3.

When the motor (not shown) is first rotated in response to a printing command, the feed rod 3 rotates in the counterclockwise direction to begin the feeding of the entire framework 1 in the figure direction. The position of the outer framework 1 while being fed is detected by the detection plate 16 which rotates in synchronization with the feeding of the outer framework. Simultaneously, the rotary shaft 4 also begins to rotate and each time the outer framework 1 and accordingly, the bar 6 is fed by the distance corresponding to the pitch distance between adjacent dots, one of the projections 5*a* on the rotary cam 5 pushes the pin 10*a* upwardly to rock the rocking plate 10 in the counterclockwise direction. In the embodiment as described hereinabove, just before or simultaneously when the bar 6 reaches any one of the positions (1-2), (1-3), (1-4) and (1-10), a printing selection command is provided to the control circuit to supply electric current to the coil 12 to thereby cause the bar 6 to spring out or protrude to effect a desired dot printing. When the outer framework 1 has reached the end of the feed stroke, the feeding direction of the outer framework is reversed and the outer framework is moved in the reverse direction to the initial position. As the outer framework moves in the reverse direction, just before the bar 6 reaches the first striking position (1-12), the platen 15 is rotated in the counterclockwise direction to feed the recording paper 19 by one pitch (the pitch distance between adjacent dots in a matrix) in the figure direction. Thus, in the feeding of the outer framework 1 in the reverse direction, the bar 6 is ready to print dots in the second column. In this case, it is contemplated that a printing selection command is produced in each of the dot positions (II-10), (II-9), (II-5) and (II-1). Thereafter, each time one column is to be printed, the recording paper is fed by the distance corresponding to one pitch and dot printing is effected for dots in the II–VI columns by repeating the same procedure to thereby form characters "2" and "1".

Figure 4:
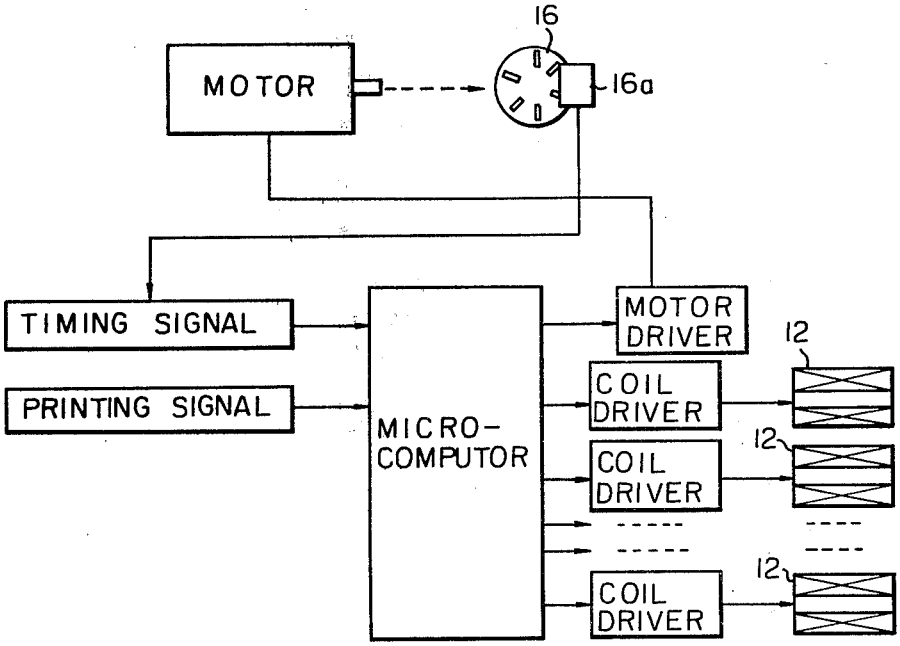
FIG. 4 is a schematic block diagram of the control circuit incorporated in the bar drive device of the invention.

FIG. 4 schematically shows the control circuit incorporated in the bar drive device of the invention and the control circuit includes a microcomputer, a motor drive and coil drivers. In operation, a printing command is provided to the microcomputer which in turn provides its output to the motor drive to drive the motor. When driven, the motor rotates the detection plate and a timing signal from the photocoupler 16*a* is provided to the microcomputer and the output of the microcomputer operates a selected coil driver in a timed relationship so as to energize the associated coil 12. When energized, the coil 12 causes the associated bar to effect a desired dot printing as mentioned hereinabove and at the same time, the feed rod 3 shifts the dot printing position of the outer framework 1 and the recording paper 19 is fed by one pitch.

With the abovementioned construction and arrangements of the components of the bar drive device of the present invention, the dot printing or striking force of the bar is not affected by the attraction function of the electromagnetic device and the size of the entire bar drive device can be minimized. Furthermore, since the operation timing of the bar can be mechanically controlled, a precise operation timing can be obtained.

While only one embodiment of the invention has been shown and described in detail, it will be understood that the same is for illustration purpose only and not to be taken as a definition of the invention, reference being had for this purpose to the appended claims.

What is claimed is:

1. A dot printing device, including;

at least one dot printing bar supported for movement between a retracted position and an extended striking position;

an electromagnet having a movable pole piece and a movable armature each of which is movable relatively to the other prior to energization of the electromagnet, and which are magnetically attracted to each other and move in unison upon energization of the electromagnet;

a drive source for intermittently rocking said armature between a position adjacent said movable pole piece and a position spaced therefrom;

a driving connection between said pole piece and said bar, said pole piece, upon energization of the electromagnet, moving in unison with the armature and in turn moving said bar from said retracted position to extended striking position; and means operable by said drive source to shift the dot printing position of said bar.

2. The device for driving dot printing bars in a dot printer as set forth in claim 1, including a plurality of dot printing bars, an electromagnet associated with each said bar, and a pole piece and an armature associated with each said electromagnet.

* * * * *